United States Patent [19]

Dwinell et al.

[11] 4,146,148

[45] Mar. 27, 1979

[54] FRANGIBLE CLOSURE FOR CONTAINERS AND METHOD

[75] Inventors: Davis B. Dwinell, Warren; Jeremiah J. Laurizio, New Providence, both of N.J.

[73] Assignee: American Flange & Manufacturing Co. Inc., Linden, N.J.

[21] Appl. No.: 928,729

[22] Filed: Jul. 27, 1978

[51] Int. Cl.[2] ..... B65D 41/32

[52] U.S. Cl. ..... 220/270; 220/265; 220/307; 220/319; 222/541; 220/276

[58] Field of Search ..... 220/265, 266, 270, 276, 220/94 A, 319, 306, 307; 222/541, 529; 215/250, 253, 256

[56] References Cited

U.S. PATENT DOCUMENTS

| | | | |
|---|---|---|---|
| 2,895,654 | 7/1959 | Rieke | 222/541 X |
| 3,083,858 | 4/1963 | Biedenstein | 220/265 |

*Primary Examiner*—George T. Hall

[57] ABSTRACT

A frangible closure for containers consists of a molded plastic closure sealing member and a metal crimping ring. The closure sealing member has a central tear out membrane surrounded by a sealing annulus with an annular weakened tearing zone interposed therebetween. The tear out membrane has a short cylindrical skirt depending from its lower surface and an enlarged ring pull projecting from its upper surface. The metal crimping ring overlies the sealing annulus for tight securement to a container wall opening neck. An upward force applied to the ring pull tears away the center membrane which can be then employed to reclose the opening after partial decanting of the container.

7 Claims, 6 Drawing Figures

FRANGIBLE CLOSURE FOR CONTAINERS AND METHOD

BACKGROUND OF THE INVENTION

The rapidly rising cost of packaging materials has prompted a reassessment of the closure requirements for certain liquid products distributed in industrial size containers such as five gallon cans and pails. Inasmuch as many liquid products, such as in the agricultural chemical field, are decanted rapidly in a single operation into a large vat or holding tank, the necessity for a conventional resealable pouring spout closure is questionable. Cost considerations indicate that a much simpler closure construction could just as well perform this function. Those particular container closure characteristics deemed to be of paramount importance in the above mentioned environment are firstly, the need for a heavy duty leakproof construction capable of withstanding severe abuse under varied shipping and use conditions. Secondly, the closure must be sufficiently tamperproof so as to adequately protect the container contents against undetected pilferage and substitution. Thirdly, it is important that the end user be able to gain access to, and readily decant, the entire container contents with a high degree of facility. A large pour opening that is exposed without the use of a tool or implement is most desirable. In addition to the above requirements, the provision of a very simple splash guard type of reclosure is sought for use in those instances where less than the entire pail contents are immediately poured out.

BRIEF DESCRIPTION OF THE INVENTION

In response to the above listed closure requirements this application discloses an economical yet fully effective closure fitting for cans, pails and the like where rapid volume dispensing is principally desired. The invention closure consists of a synthetic plastic closure sealing member having a frangible center membrane and peripherally disposed sealing channel. A metal crimping ring overlies the sealing channel for tightly securing the closure to a neck formed about a container wall opening. Once this closure assembly is applied with a suitable crimping tool, the container is effectively protected against leakage and tampering during shipping and storage.

To facilitate authorized access to the container contents, the frangible membrane is surrounded by a weakened tearing zone and has a ring pull extending upwardly for ready access. Tearing away of the membrane from the surrounding sealing channel creates a pouring opening of maximum dimension ideally suited for quick and complete emptying of the container.

In the event temporary reclosing of the container is desired so as to guard against splashing and the like, the undersurface of the tear out membrane is provided with a depending skirt for cooperative engagement with the metal crimping ring when the torn out center panel is employed as a simple closure plug.

It is accordingly a principal object of the invention to provide a new and improved two piece frangible closure for containers capable of serving as a reclosure after initial opening.

Another object is to provide a new and improved crimped on tamperproof closure having a portion which is conveniently torn away to create a full size pour opening and subsequently utilized to plug such opening upon partial decanting of the container contents.

Another object is to provide a new closure utilization method.

Other and more detailed objects will be in part obvious and in part pointed out as the description of the invention taken in conjunction with the accompanying drawing proceeds.

Figure 1:
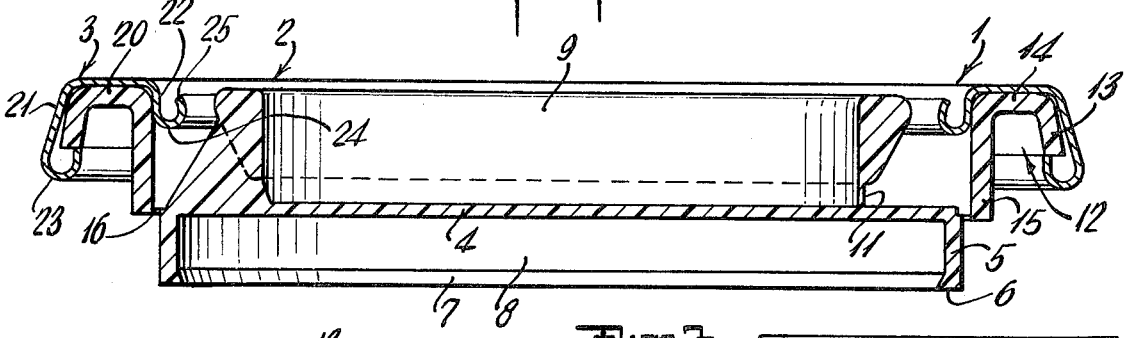
FIG. 1 is a vertical sectional view of the frangible closure of the invention.
Figure 2:
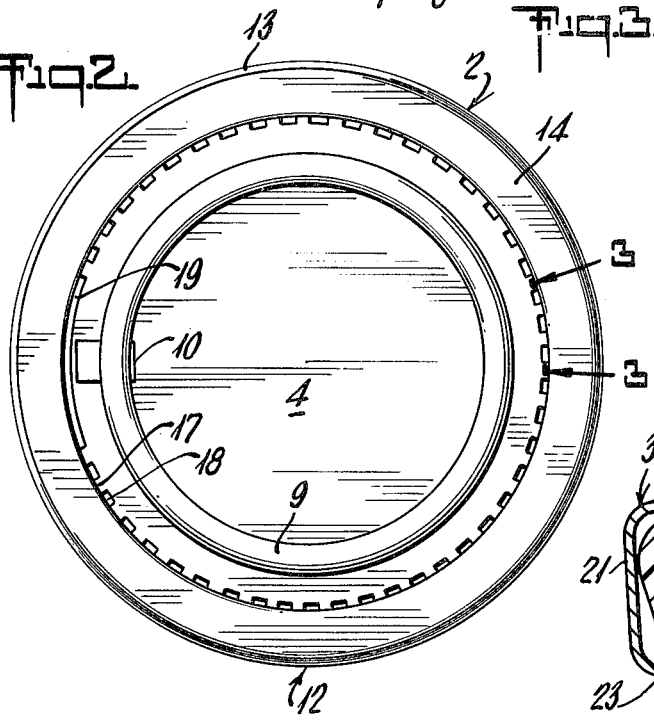
FIG. 2 is a top plan view of the closure sealing member.
Figure 3:
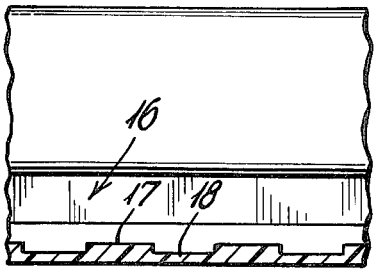
FIG. 3 is an enlarged sectional view taken on lines 3—3 of FIG. 2 and looking in the direction of the arrows.

The frangible closure of the invention generally indicated by numeral 1 consists of a closure sealing member 2 integrally molded of synthetic plastic and a metal crimping ring 3 as shown in FIG. 1. The closure sealing member 2 consists of a center tear out membrame 4 adapted to subsequently close off a container opening in a manner explained hereinafter. A short cylindrical skirt 5 depends from the periphery of the tear out membrane undersurface. As clearly seen in FIG. 4, the skirt 5 terminates in a free end 6 and has a small inwardly facing rib which extends radially inwardly of the skirt inner surface 8. A readily grasped pull ring 9 having an outside diameter slightly less than the depending skirt 5 overlies the upper surface of the membrane 4 and is securely connected thereto by an integrally molded connecting rib 10. In addition, the pull ring 9 is attached to the upper surface of the membrane 4 and retained in a position parallel thereto by a frangible web 11 located diametrically opposite the connecting rib 10. A circumferential sealing annulus 12 surrounds the center membrane 4 having an inverted channel shaped cross sectional configuration made up of an outer wall 13, a top wall 14 and an inner wall 15. The sealing annulus inner wall 15 depends vertically below the outer wall 13 and is joined by means of a weakened tearing zone 16 to the center tear out membrane 4. In FIGS. 2 and 3 the circular tearing zone 16 is shown as a score line made up of alternating relatively thick portions 17 of remaining plastic material and relatively thin portions 18. Also, as seen in FIG. 2, the score line includes a relatively thin portion of remaining plastic material 19 extending for a short distance at either side of the pull ring connecting rib 10 in order to reduce the initial resistance to tearing. The alternating thick and thin score line portions 17 and 18 respectively further lend themselves to ease of continued tearing while assuring adequate protection against accidental rupturing of the tear out panel.

Figure 4:
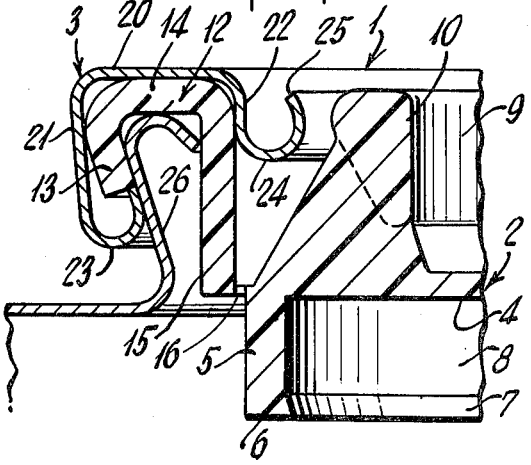
FIG. 4 is an enlarged fragmentary sectional view of the closure secured to a container wall opening neck.

The metal crimping ring 3 is dimensioned to overlie the sealing annulus 12 and, as clearly shown in FIGS. 1 and 4, has an inverted channel shaped cross sectional configuration made up of a top wall 20, an outer wall 21 and an inner wall 22. The lower end of outer wall 21 is curled radially inwardly and upwardly at 23 so as to engage the lower end of the sealing annulus outer wall 12 and thus retain the crimping ring 3 and closure sealing member 2 in assembled condition. The lower end of the sealing ring inner wall 22 is also curled radially inwardly and upwardly forming an upwardly opening channel 24. Here it is important to note, however, that the channel 24 follows a substantially circular contour as viewed in vertical cross section so as to create a partially open bead. The free edge 25 of the bead or channel 24 is thus formed radially outwardly with regard to the opening beyond the major diameter of the channel 24 and terminates at a point spaced radially inwardly of the crimping ring inner wall 22.

As shown in FIG. 4 the assembled closure 1 is secured to an upstanding neck 26 surrounding a container wall opening of a filled container. A liquid tight joint between the closure 1 and the opening neck 26 is formed by crimping the outer wall 21 of the metal crimping ring 3 radially inwardly.

The filled container, with dispensing opening sealed off as described above, is ready for shipment and the rough handling normally encountered with industrial or agricultural use containers such as five gallon pails. On receipt of the filled container, the end user can immediately detect any tampering or pilferage by noting if the sealing membrane 4 is still intact. Authorized access to the container contents is then very simply gained by grasping the pull ring 9 causing the frangible web 11 to break away from the membrane 4. Once the pull ring is feed from the membrane, it can be easily pulled out at an angle causing initial rupture of the tearing zone 16 at the thinned out portions 19 on either side of the connecting rib 10. At this point the overlying inner wall 22 of the metal crimping ring 3 acts to anchor at least the upper portion of the sealing annulus inner wall 15 thus further aiding initial rupture of the tearing zone. Continued pulling on the ring 9 then quite readily beaks the thicker score line portions 17 whereupon the entire membrane 4 is removed. It should be noted that the relative flexibility of the tear out membrane 4 and its associated depending skirt 5 permit easy removal as above described even though the outside diameter of the membrane 4 and skirt 5 is greater than the inside diameter of the channel 24. An enlarged pouring opening is thus formed through which the container contents can be rapidly dispensed. Complete drainage of the container when held in pouring position is permitted by having the lowermost extent of the sealing annulus inner wall 15 nested within the opening neck 26 and suspended vertically above the surrounding container wall surface.

Figure 5:
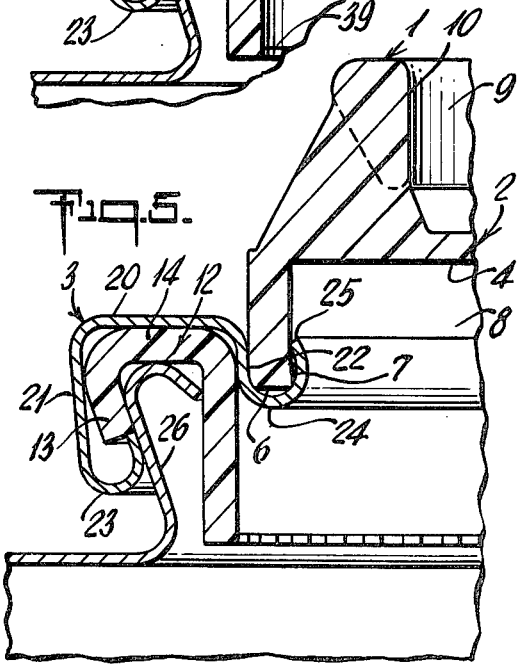
FIG. 5 is a view similar to FIG. 4 showing the closure tear out membrane utilized as a reclosure.

While in many instances complete and rapid emptying of the container is the desired mode of usage, it is frequently desirable to temporarily reclose the container so that it can be moved or otherwise handled without the remaining contents splashing out. To satisfy this need, as shown in FIG. 5, the torn out center membrane 4 can be placed over the pouring opening so that the outer surface of the cylindrical skirt 5 fits snugly within the diameter of the metal crimping ring inner wall 22. By pressing the membrane downwardly about its periphery, the relatively flexible rib 7 on the skirt 5 is forced past the exposed free metal edge 25 and into the channel 24. The radial cross-sectional dimension of the skirt 5 and the mouth of the channel 24 is such that as the rib 7 moves deeper into the channel, the metal edge 25 forms a tight friction fit with the skirt inner surface 8. Due to the curvature at the bottom of the channel 24, firm downward pressure about the membrane periphery causes the lowermost end 6 of the skirt 5 to be urged radially inwardly. This in turn forces the metal edge 25 to bite deeper into the skirt inner surface 8 and lock the rib 7 within the confines of the channel 24.

The resultant retention of the torn out membrane 4 which now serves as a plug, within the inner confines of the specially formed crimping ring accordingly provides an effective reclosure of the container opening so as to prevent spillage or sloshing out of the liquid contents. To unplug the opening, the ring pull 9 is again simply grasped and pulled upwardly to dislodge the skirt 5 from the channel 24.

Figure 6:
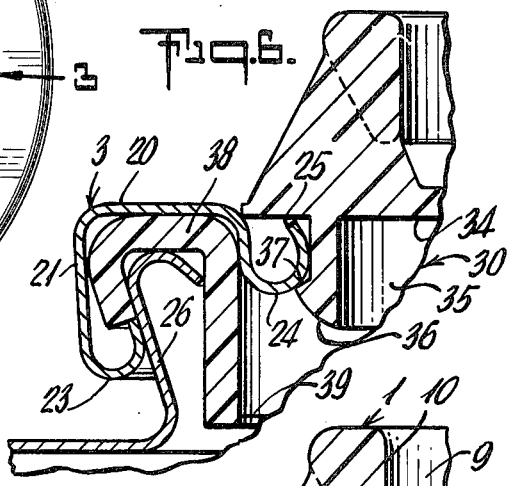
FIG. 6 is a view similar to FIG. 5 showing a modified form of the invention.

In the form of the invention shown in FIG. 6, the metal crimping ring 3 is assembled with an alternate sealing member 30 having a center tear out membrane 34. A cylindrical skirt 35 depends from the undersurface of the tear out membrane disposed radially inwardly from the membrane periphery. The lower free edge of the skirt 35 terminates in a circumferentially extending locking foot 36 which extends upwardly and radially outwardly and presents an upwardly facing annular surface 37. As described in the FIG. 1 embodiment, the membrane has an upwardly projecting pull ring and is surrounded by a sealing annulas 38 interconnected by means of a tearing zone 39. In this form of the invention the center panel 34 is torn out of the sealing annulus 38 and, after partial dispensing of the container contents, may also be reinserted within the pouring opening. This causes the locking foot 36 to be cammed past the channel edge 25 and then snapped underneath the channel so that the channel is snugly confined between the undersurface of the center membrane about its periphery and the upper foot surface 37.

From the foregoing it can be seen that an improved container closure and method has been brought forth which enables heavy duty pails and cans to be safely sealed off against leakage and tampering in an economical fashion. After dispensing through a maximum diameter pour opening, the very simple two piece closure fitting is then capable of being effectively reclosed for normal handling and storage purposes without reliance on relatively costly inter-engaging threaded parts.

Various other changes in or modifications of the closure construction and different embodiments of the invention would suggest themselves to those skilled in the art and could be made without departing from the spirit or scope of the invention. It is, accordingly, intended that all matter contained in the above description or shown in the accompanying drawing shall be interpreted as being illustrative and not in a limiting sense.

We claim:

1. A container closure comprising a synthetic plastic closure sealing member and a metal crimping ring, said closure sealing member including a disc-like central tear out membrane surrounded by an integrally molded sealing annulus, said sealing annulus having a downwardly opening channel shaped cross-sectional configuration, a weakened tearing zone interposed between said central membrane and said sealing annulus, integrally molded gripping means projecting from the upper surface of said membrane, a cylindrical skirt depending from the undersurface of said membrane disposed radially inwardly of said tearing zone, said crimping ring overlying said sealing annulus whereby said membrane can be torn out of said sealing sealing annulus and subsequently employed to reclose the opening thus formed.

2. A container closure as in claim 1 wherein said tearing zone is disposed radially outwardly of the innermost diameter of said crimping ring.

3. A container closure comprising a synthetic plastic closure sealing member and a metal crimping ring, said closure sealing member having an imperforate central membrane surrounded by an integrally molded sealing annulus, a weakened tearing zone interposed between said membrane and said sealing annulus, integrally molded gripping means projecting from the upper surface of said membrane, reclosing means formed on said central membrane, said crimping ring being formed with a downwardly opening channel shaped cross-sectional configuration consisting of a top wall, a depending outer wall and a depending inner wall and means formed on said inner wall to receive said reclosing means after said central membrane is torn out of said sealing annulus and subsequently employed to reclose the opening thus formed.

4. A container closure as in claim 3 wherein said receiving means provides both an axial and a radial engagement with said reclosing means.

5. A closure utilization method comprising the steps of seating a plastic closure sealing member and metal crimping ring assembly on an upstanding neck surrounding a container wall opening, circumferentially deforming said crimping ring to secure said assembly onto said neck, gaining initial access to the sealed container by tearing a center membrane out of said closure sealing member to form a pouring opening, subsequently reclosing the container by inserting the torn out center membrane within said crimping ring and supporting said torn out membrane in reclosing position against displacement within said container.

6. A closure utilization method as in claim 5 and effecting said supporting on a portion of said metal crimping ring.

7. A closure utilization method as in claim 5 and axially withdrawing said torn out center membrane through an opening in said metal ring having a smaller diameter than the diameter of said membrane.

* * * * *